US007909418B2

(12) United States Patent
McFarland

(10) Patent No.: US 7,909,418 B2
(45) Date of Patent: Mar. 22, 2011

(54) DISPENSING SYSTEM FOR TOOLS

(75) Inventor: John McFarland, Warwickshire (GB)

(73) Assignee: Iscar, Ltd., Tefen (IL)

( * ) Notice: Subject to any disclaimer, the term of this patent is extended or adjusted under 35 U.S.C. 154(b) by 1133 days.

(21) Appl. No.: 11/530,095

(22) Filed: Sep. 8, 2006

(65) Prior Publication Data

US 2007/0228899 A1 Oct. 4, 2007

(30) Foreign Application Priority Data

Sep. 8, 2005 (IL) ..... 170755

(51) Int. Cl.
*E05B 65/46* (2006.01)

(52) U.S. Cl. ..... 312/215

(58) Field of Classification Search ..... 312/330.1, 312/334.1, 338.3, 348.5, 216, 217, 220, 221, 312/222, 107.5, 218, 209, 270.1, 270.2, 270.3, 312/139; 70/85, 86, 87, 88, 159, 160, 161, 70/162; 109/53, 54, 55, 56, 57; 700/231, 700/242, 236

See application file for complete search history.

(56) References Cited

U.S. PATENT DOCUMENTS

| | | | | | |
|---|---|---|---|---|---|
| 2,585,919 | A | * | 2/1952 | Davis | 312/287 |
| 2,803,512 | A | * | 8/1957 | Band | 312/298 |
| 3,597,036 | A | * | 8/1971 | Buffington | 312/217 |
| 3,930,388 | A | * | 1/1976 | Barras | 70/159 |
| 4,130,326 | A | * | 12/1978 | Hornblad | 312/292 |
| 4,453,743 | A | * | 6/1984 | Sanders et al. | 281/18 |
| 4,635,454 | A | * | 1/1987 | Brown | 70/139 |
| 4,961,507 | A | | 10/1990 | Higgins | |
| 5,172,097 | A | * | 12/1992 | Arnold | 340/543 |
| 5,408,443 | A | * | 4/1995 | Weinberger | 368/10 |
| 5,691,879 | A | * | 11/1997 | Lopez et al. | 361/679.57 |
| 5,745,366 | A | | 4/1998 | Higham et al. | |
| 5,805,456 | A | | 9/1998 | Higham et al. | |
| 5,819,981 | A | | 10/1998 | Cox | |
| 6,011,999 | A | | 1/2000 | Holmes | |
| 6,109,709 | A | | 8/2000 | Holcomb et al. | |
| 6,109,774 | A | | 8/2000 | Holmes et al. | |
| 6,116,461 | A | | 9/2000 | Broadfield et al. | |
| 6,175,779 | B1 | * | 1/2001 | Barrett | 700/242 |
| 6,189,727 | B1 | | 2/2001 | Shoenfeld | |

(Continued)

FOREIGN PATENT DOCUMENTS

WO WO 2004 014189 2/2004

OTHER PUBLICATIONS

International Search Report, PCT/IL2006/001013, dated Feb. 22, 2007.

*Primary Examiner* — Darnell M Jayne
*Assistant Examiner* — Timothy M Ayres
(74) *Attorney, Agent, or Firm* — Womble Carlyle

(57) ABSTRACT

A tool dispensing system has one or more drawers, each drawer having one or more bins. Each bin occupies at least one cell of a drawer cell array which has an integer number M cell columns and an integer number N cell rows. The bins are provided with lockable lids and are selectively transferable between a bin released position and a bin locked position. The bins are transferred between these position through the use of no greater than M actuators for each drawer.

15 Claims, 10 Drawing Sheets

U.S. PATENT DOCUMENTS

| | | | | |
|---|---|---|---|---|
| 6,338,007 | B1 | 1/2002 | Broadfield et al. | |
| 6,481,808 | B2 * | 11/2002 | Cinese | 312/118 |
| 6,640,159 | B2 * | 10/2003 | Holmes et al. | 700/244 |
| 7,077,286 | B2 | 7/2006 | Shows et al. | |
| 7,142,944 | B2 | 11/2006 | Holmes et al. | |
| 7,293,673 | B2 | 11/2007 | Savage et al. | |
| 7,657,344 | B2 | 2/2010 | Holmes et al. | |
| 2004/0108795 | A1 | 6/2004 | Meek | |
| 2005/0046317 | A1 * | 3/2005 | Howard | 312/334.27 |
| 2006/0232381 | A1 * | 10/2006 | Gauthier | 340/5.73 |

* cited by examiner

DISPENSING SYSTEM FOR TOOLS

FIELD OF THE INVENTION

The present invention relates to dispensing systems, and particularly to controlled access dispensing systems storing tools.

BACKGROUND OF THE INVENTION

Such storage and dispensing systems are known, for example, from U.S. Pat. No. 5,745,366, which discloses a pharmaceutical dispensing device for providing access to items to be dispensed and for maintaining an inventory of the items. A dispensing unit is provided having an enclosure with an interior and with a plurality of storage locations distributed over a surface of the enclosure. Sensors associated with at least some of the individual storage locations are provided. The unit further includes a multiplicity of receptacles disposed within at least some of the storage locations. Sensors associated with at least some of the individual receptacles are provided. A processor is disposed on the enclosure and connected to receive signals from the storage location-associated sensors and the receptacle-associated sensors to track item replenishment or removal from the receptacles.

U.S. Pat. No. 4,961,507 discloses a dispensing machine having various items to be dispensed arranged in a selected pattern. The system responds to a request for an item by verifying the authority of the user and dispensing the requested item. Pneumatic matrix switching is provided to control the selection and dispensing of the items. The pneumatic matrix has a plurality of fluid cylinders, each cylinder arranged to provide a dispensing stroke, is assigned a selected column address and a row address, and is maintained under an initial fluid pressure. The pneumatic matrix further has first actuator means, second actuator means, and means to selectively activate one each of said first and second actuator means. The first actuator means comprises a fluid valve for each column address connected in common fluid communication to each fluid cylinder having the same column address and operative to condition each cylinder at said column address for actuation. The second actuator means comprises a fluid valve for each row address connected in common fluid communication to each fluid cylinder having the same row address operative to condition each cylinder at said row address for actuation. The means to selectively activate one each of said first and second actuator means conditions the cylinders having one column address and one row address for actuating and activates the cylinder having said one column and said one row address to provide a dispensing stroke. The invention facilitates operating a pneumatic matrix of M columns by N rows having M×N cylinders using M+N actuators.

SUMMARY OF THE INVENTION

It is an object of the present invention to provide an improved dispensing system. In accordance with one aspect of the present invention, there is preferably provided a dispensing system having at least one drawer comprising a plurality of bins each occupying at least one cell of a drawer cell array having an integer number M cell columns and an integer number N cell rows. The bins are provided with lockable lids and are selectively transferable between bin released and bin locked positions by actuators, wherein the number of actuators for the at least one drawer is not greater than M per drawer.

Preferably, the at least one drawer comprises at most N compartments defined each between adjacent drawer dividers extending transversely to a sliding direction of the drawer.

Further preferably, each drawer divider comprises a plurality of bin partition slots arrayed equidistantly therealong defining M equally-sized divider segments thereon, each divider segment comprising spaced-apart lid hinge apertures and a locking slot located therebetween.

Generally, each drawer divider accommodates a locking bar transferable between bar locking and bar releasing positions and comprising M locking latches extending therefrom and arrayed equidistantly therealong. Each locking latch comprises a bolt portion extending parallel to the locking bar. When the locking bar is in the bar locking position, each bolt portion extends across the locking slot associated therewith, and when the locking bar is in the bar releasing position, each bolt portion is withdrawn from the associated locking slot.

If desired, each lid is transferable from a lid closed position, in which the lid covers the bin, to a lid open position, in which the lid is lifted from the bin to allow access thereto.

If further desired, each lid is provided with at least one catch comprising a strike having a strike aperture formed therein, the strike extending forwardly through a strike slot formed at a catch front portion.

Typically, the catch can be transferred relative to the lid from a catch closed position to a catch open position, so that in the catch closed position, a catch top face is generally parallel to a lid top face and the catch front portion extends below a lid bottom face. In the catch open position, the catch front portion is raised above the lid top face.

Preferably, the catch is biased towards the catch open position.

Further preferably, in the bin locked position, the lid is in a lid closed position, the catch is in the catch closed position, the strike is located in the locking slot of the divider segment adjacent thereto, and the bolt portion of the locking latch associated with the locking slot extends through the strike aperture.

Yet further preferably, when the bin is in the bin released position, the bolt portion is withdrawn from the strike aperture and the catch is transferred to the catch open position by the biasing force of the catch biasing spring.

Generally, the drawer is slidable relative to an associated drawer support fixed to a cabinet, the drawer support comprising a securing beam having a single row of M equally-spaced actuators extending transversely to the sliding direction, each actuator being transferable between actuator securing and actuator releasing positions.

If desired, each actuator is associated with a lid securing lever transferable between lever lowered and lever raised positions.

If further desired, when the lid securing lever is in the lever lowered position, and the actuator is in the actuator securing position, the lid securing lever is prevented from transferring to the lever raised position.

If yet further desired, when the lid securing lever is in the lever lowered position, and the actuator is in the actuator securing position, the lid securing lever urges lids and catches sliding adjacent thereto to the lid closed and catch closed positions.

In accordance with another aspect of the present invention, there is preferably provided a method for selectively transferring a given bin between bin locked and bin released position, the bin occupying at least one cell in a drawer cell array of M cell columns and N cell rows defined in a slidable drawer. The method comprises:

a. providing at least one non-sliding actuator (138) associated with the at least one cell column (96);

b. sliding the drawer (34) from a fully pushed-in towards a fully pulled-out position; and c. selectively transferring the at least one non-sliding actuator (138) from an actuator securing position to an actuator releasing position as the given bin (40) slides adjacent thereto, thereby facilitating selective transferring of the given bin from the bin locked to the bin released position.

If desired, the given bin is defined between two adjacent drawer dividers extending transversely to a sliding direction of the slidable drawer, at least one drawer divider comprising a locking bar slidable therein between bar locking and bar releasing positions, the locking bar comprising at least one locking latch having a bolt portion extending parallel thereto, the drawer divider having at least one locking slot associated with the given bin, and the lid comprising at least one strike having a strike aperture formed therein.

The method may then further comprise:

d. initially positioning the lid in a lid closed position and the locking bar in the bar closed position, with the strike extending into the associated locking slot and the bolt portion extending through the strike aperture, thereby positioning the bin in the bin locked position; and e. transferring the locking bar to the bar releasing position as the drawer slides the given bin slides adjacent to the at least one actuator, thereby withdrawing the bolt portion from the strike aperture and releasing the bin to be selectively transferable to the bin released position.

BRIEF DESCRIPTION OF THE DRAWINGS

For a better understanding of the present invention and to show how the same may be carried out in practice, reference will now be made to the accompanying drawings, in which.

DETAILED DESCRIPTION OF THE INVENTION

Figure 1:
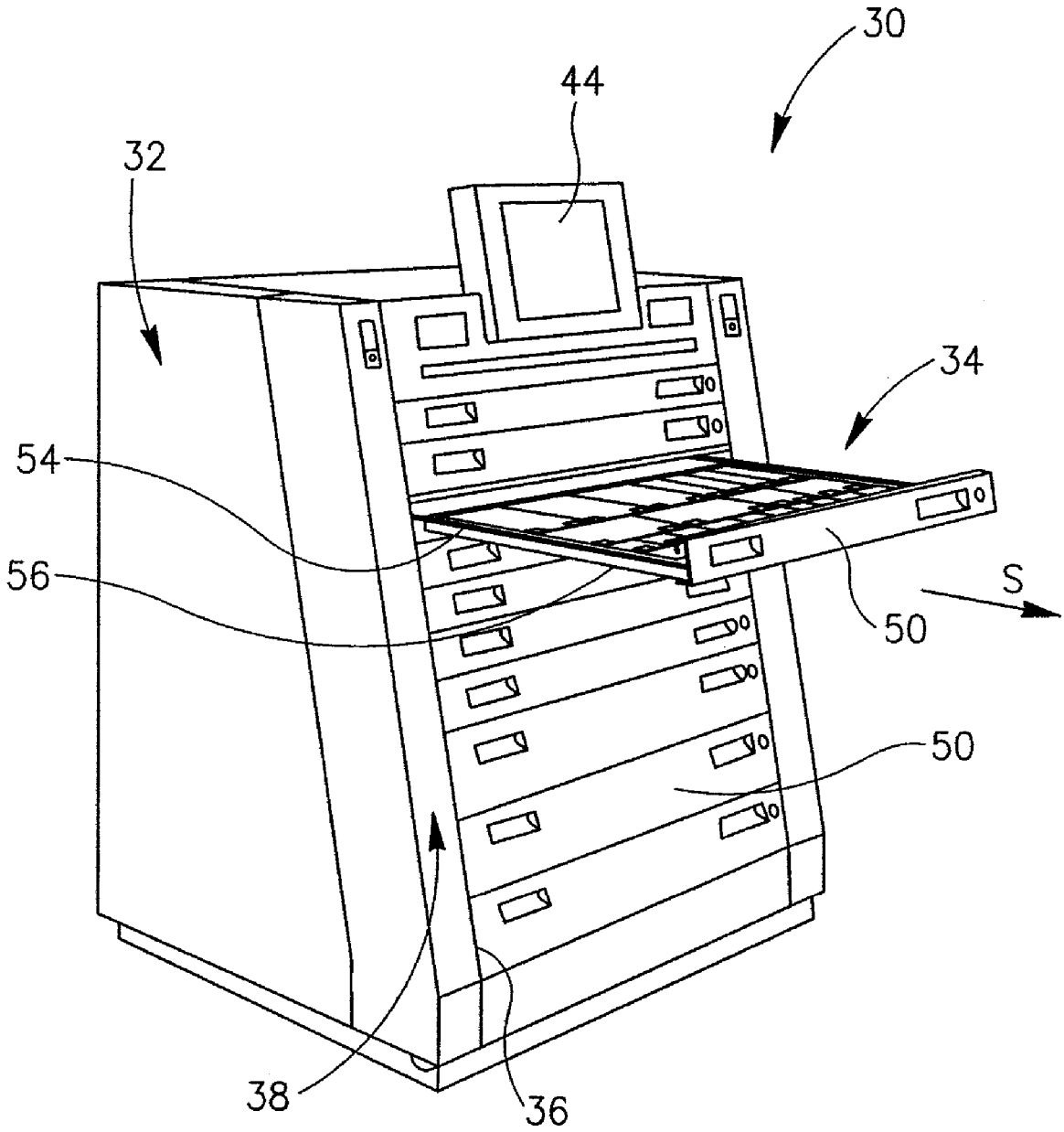
FIG. 1 is a perspective view of a dispensing system in accordance with the present invention.
Figure 2:
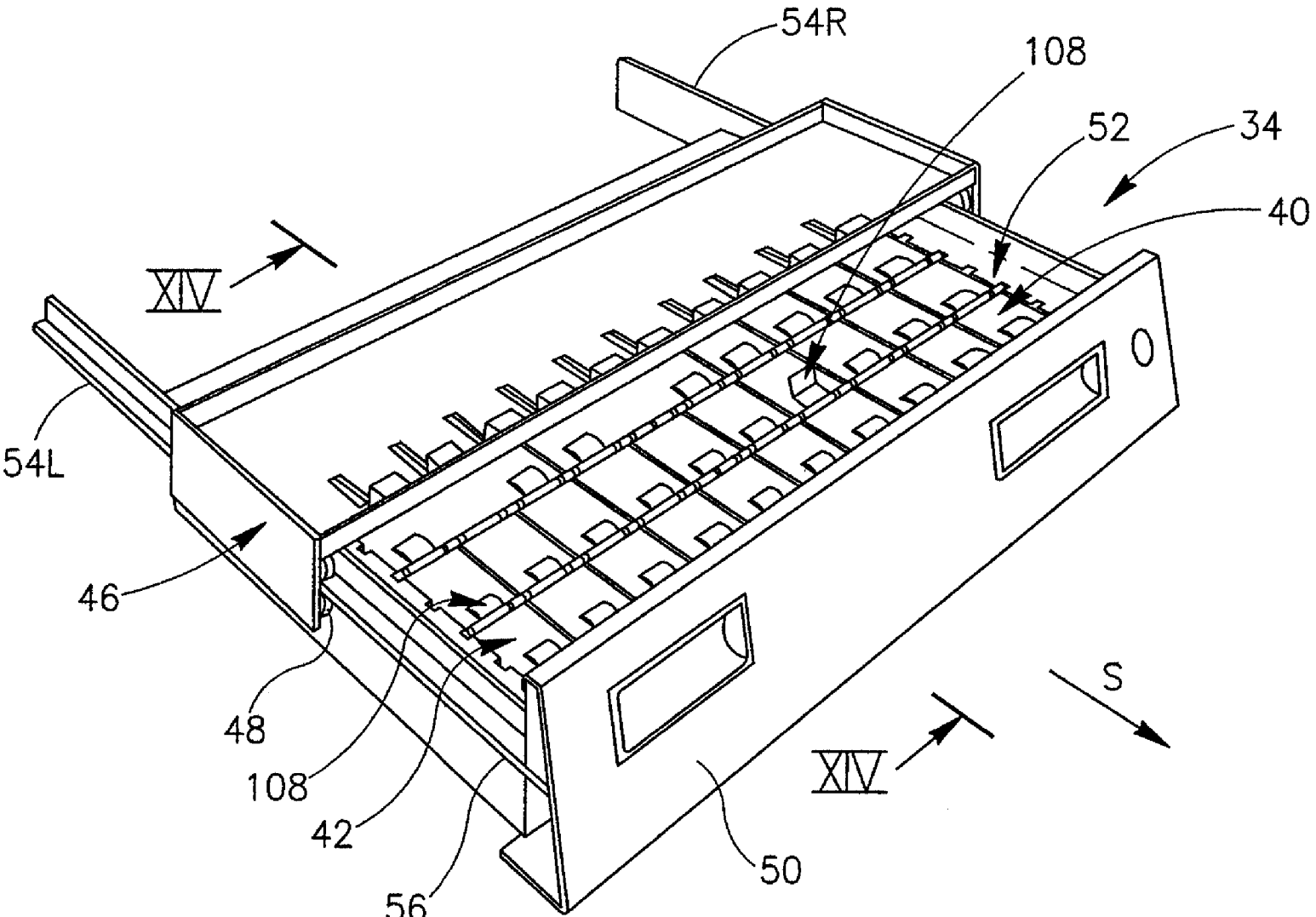
FIG. 2 is a perspective view of a drawer and an associated drawer support of the dispensing system shown in FIG. 1.

Attention is drawn to FIGS. 1 and 2. A dispensing system 30 has a cabinet 32 accommodating a plurality of drawers 34. Each drawer 34 slides in and out of the cabinet 32 along a rear-to-front sliding direction S, through a cabinet opening 36 formed at a cabinet front face 38. The drawer 34 is continuously positionable between fully pushed-in and fully pulled-out positions. It should be noted that directional terms appearing throughout the specification and claims, e.g. "front", "rear", etc., (and derivatives thereof) are for illustrative purposes only, and are not intended to limit the scope of the appended claims. The drawer 34 stores items in a plurality of bins 40 provided with lockable and selectively-releasable lids 42. The lids 42 are controlled by an access-control system (not shown). The access-control system may have, for example, a combined display and input device, e.g., a touch screen 44, through which users may issue dispensing or restocking requests, and a user identification means (not shown) such as card readers or biometric means, so that the system may identify the user and determine whether the user is authorized to withdraw or replenish a specific item. However, the access-control system does not constitute the subject matter of the present invention, and therefore it will not be described further herein. Each drawer 34 is associated with a drawer support 46 secured to the cabinet 32 and having drawer guide wheels 48 on which the drawer 34 slides in and out of the cabinet 32. When the drawer 34 is in the fully pushed-in position, a drawer front panel 50 is flush with the cabinet front face 38.

Figure 3:
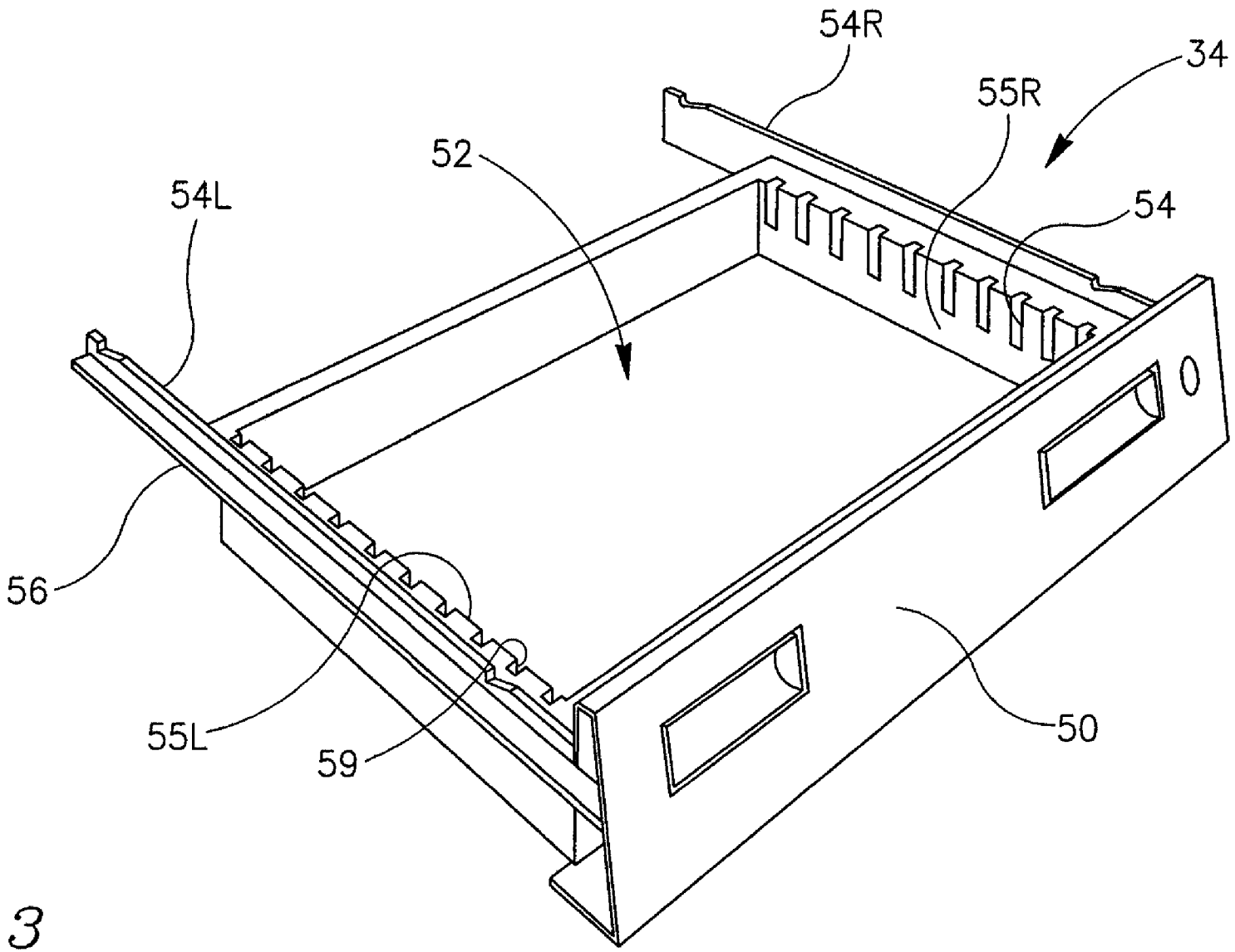
FIG. 3 is a top view of the drawer shown in FIG. 2.

As is best shown in FIG. 3, the drawer 34 has a drawer tub 52 in which the bins 34 are located. The drawer tub 52 is supported by drawer right and left side-rails $\mathbf{54}_R$, $\mathbf{54}_L$ mounted to right and left tub sidewalls $\mathbf{55}_R$, $\mathbf{55}_L$, respectively. The drawer right and left side-rails $\mathbf{54}_R$, $\mathbf{54}_L$ are connected to the drawer front panel 50 and extend rearwardly therefrom. The terms "left" and "right" are defined from a point of view of the user standing in front of the cabinet 32 and facing the cabinet front face 38. Each of the right and left side-rails $\mathbf{54}_R$, $\mathbf{54}_L$ is provided with a slide 56 to support the drawer 34 on the guide wheels 48 of the drawer support 46. Each of the right and left tub sidewalls $\mathbf{55}_R$, $\mathbf{55}_L$ has (N+1) of divider slots 59 formed therein and spaced equidistantly therealong.

Attention is additionally drawn to FIGS. 4 to 10. A row of bins 40 defines a compartment 58 (see FIG. 10). Each compartment is bounded by a pair of adjacent drawer dividers 60. Each drawer divider 60 is of a generally elongated rectangular shape, extending perpendicularly to the sliding direction S between two opposing divider slots 59 disposed in the right and left tub sidewalls $\mathbf{55}_R$, $\mathbf{55}_L$. Each drawer divider 60 accommodates an elongated, flat locking bar 62 having an integrally formed releasing rod 64 extending rightwardly thereof. M locking latches 66 extend upwardly from the locking bar 62 and are spaced equidistantly therealong. Each locking latch 66 is of an L-shape, and has a bolt portion 68 extending parallel to the locking bar 62. A bar mounting slot 70 is formed in the locking bar 62. The bar mounting slot 70 accommodates a locking spring 72 confined between a divider bolt 74 and a mounting slot right end 76. The divider bolt 70 extends through the bar mounting slot 70 and is affixed to the drawer divider 60. The locking spring 72 biases the locking bar 62 rightwards to a bar locking position. The locking bar 62 may be urged leftwards to a bar releasing position, as will be further discussed below. The releasing rod 64 of the drawer divider 60 protrudes through a tub right side-wall $\mathbf{55}_R$ to a side-wall outer side 80 of the drawer tub 52.

Each drawer divider 60 has a plurality of bin partition slots 82 spaced equidistantly therealong defining M equally-sized divider segments 84. Two spaced-apart lid hinge apertures 86 and one locking slot 88 located therebetween are formed in each divider segment 84. When the locking bar 62 is in the bar locking position, each bolt portion 68 thereof extends across the locking slot 88 associated therewith. When the locking bar 62 is in the bar releasing position, each bolt portion 68 thereof is withdrawn from the locking slot 88.

Figure 9:
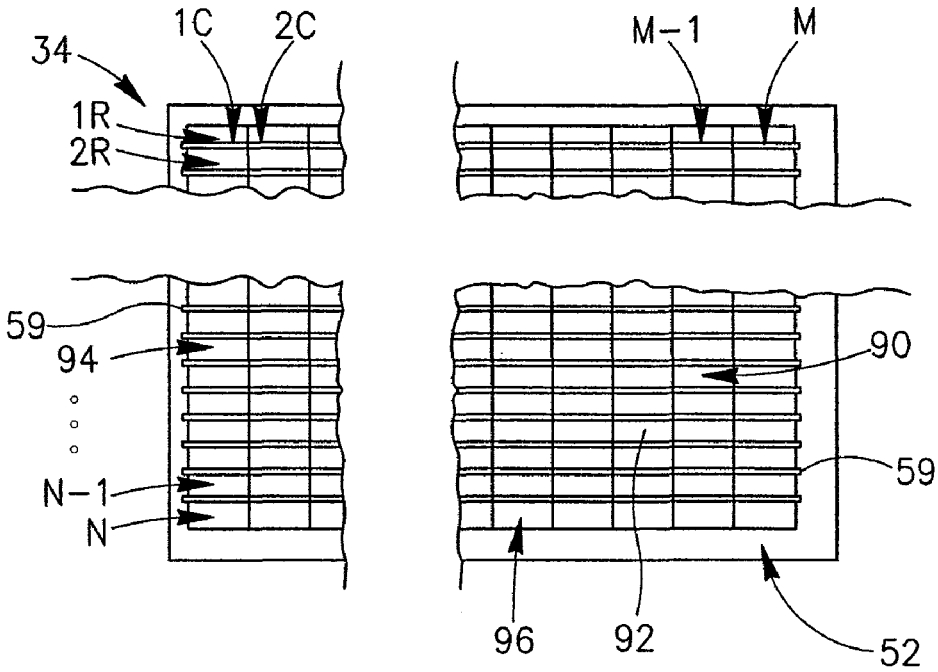
FIG. 9 is a schematic top view of a cell array of the drawer shown in FIG. 2.
Figure 10:
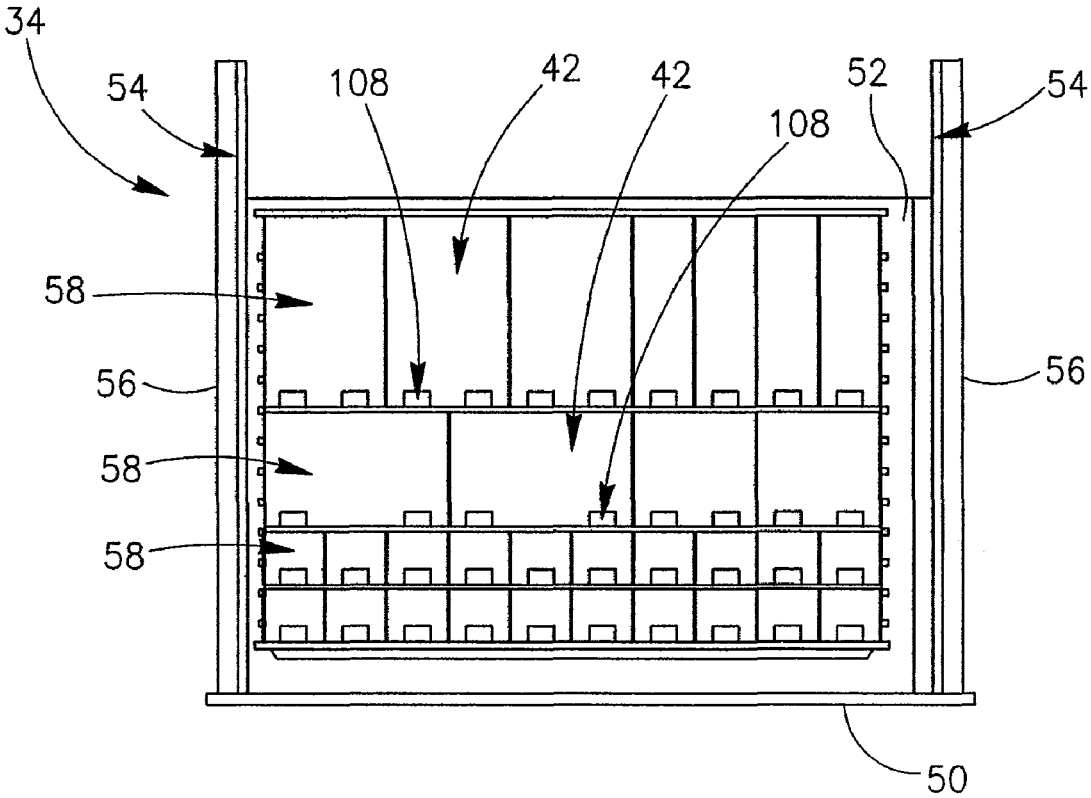
FIG. 10 is a top view of the drawer shown in FIG. 2.

Referring now particularly to FIGS. 9 and 10, the divider slots 59 and the bin partition slots 82 define a drawer cell array 90 having a plurality of identical cells 92. The cells 92 of the cell array 90 are arranged in N cell rows 94 and M cell columns 96. Each cell row 94 extends transversely to the sliding direction S. Each cell column 96 extends parallel to the sliding direction S. Numerals 1R, 2R, and 1C, 2C, shown in FIG. 9, indicate an ordinal number of row and columns, respectively.

Each compartment 58 may extend over one or more cell rows 94. Each compartment 58 may be divided into individual bins 40 by placing bin partitions 98 in opposing bin partition slots 82 of the two adjacent drawer dividers 60 defining the compartment 58. All the bins 40 in a given compartment 58 extend over the same number of cell rows 94; however different bins 40 of the same compartment 58 may extend over differing numbers of cell columns 96.

Figure 4:
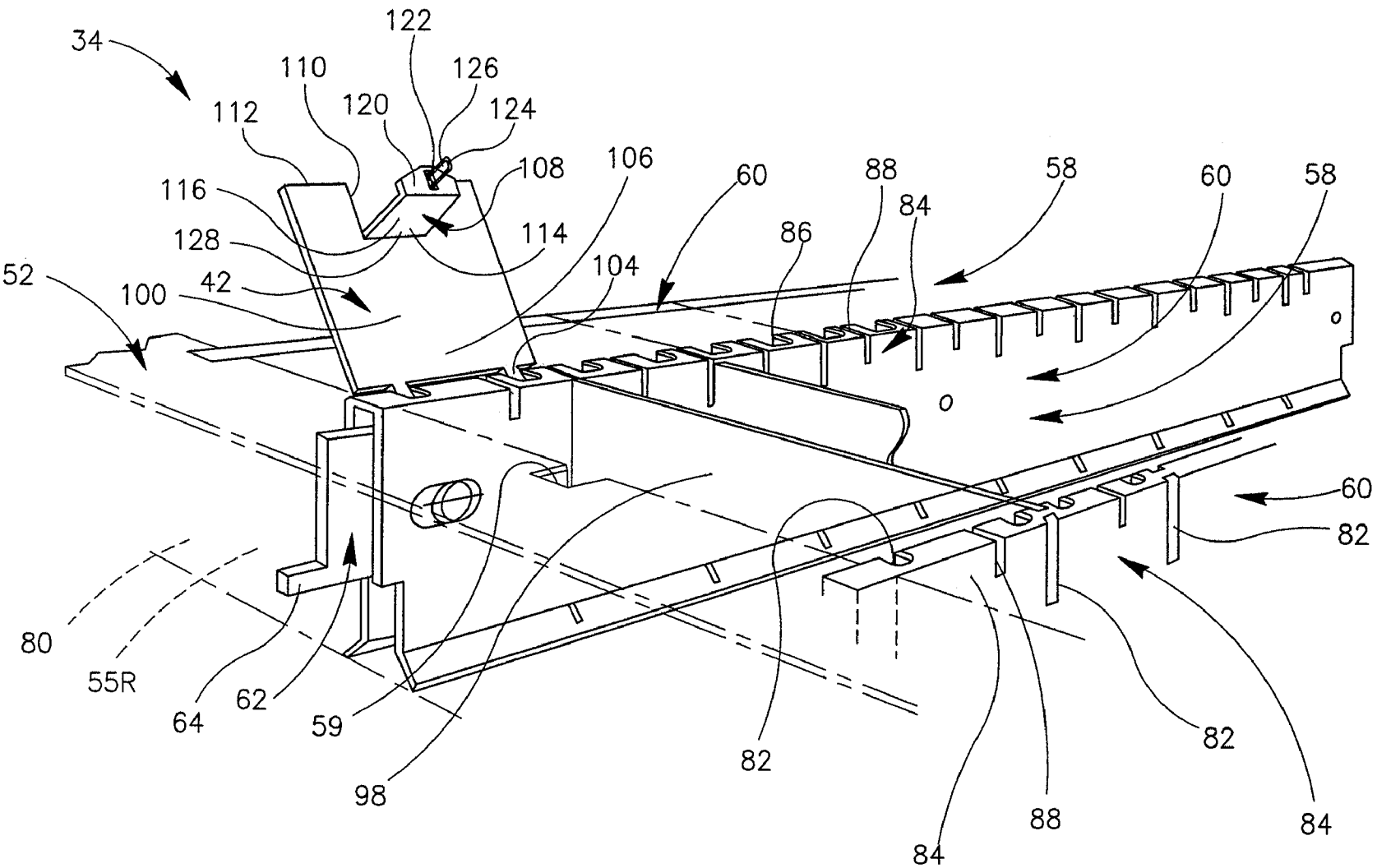
FIG. 4 is a top rear perspective view of a drawer divider of the drawer shown in FIG. 2.
Figure 5:
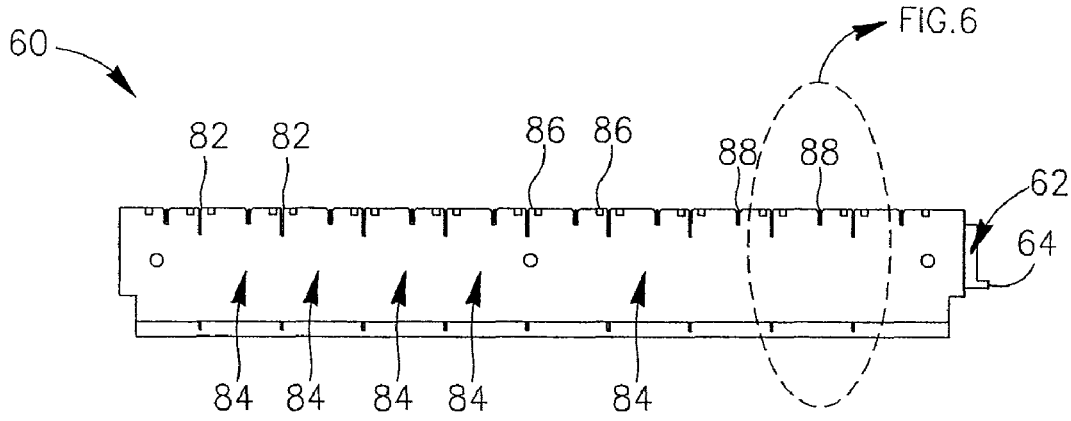
FIG. 5 is a front view of the drawer divider shown in FIG. 4.
Figure 6:
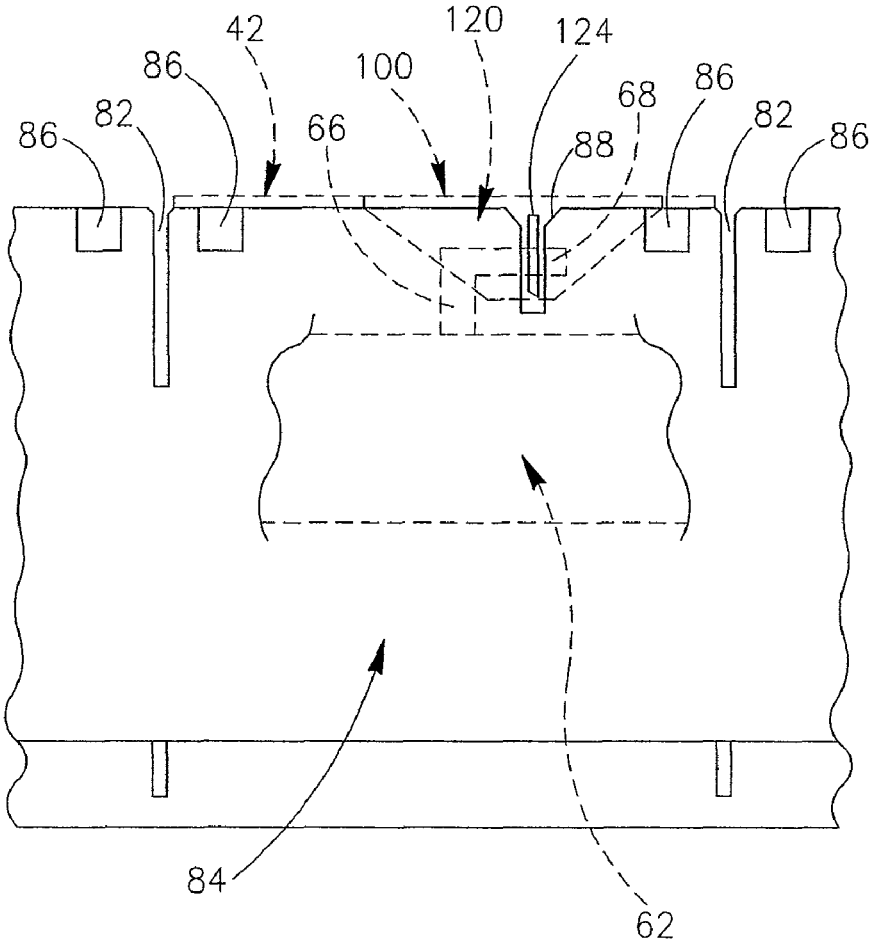
FIG. 6 is detail view of the drawer divider shown in FIG. 5.
Figure 7:
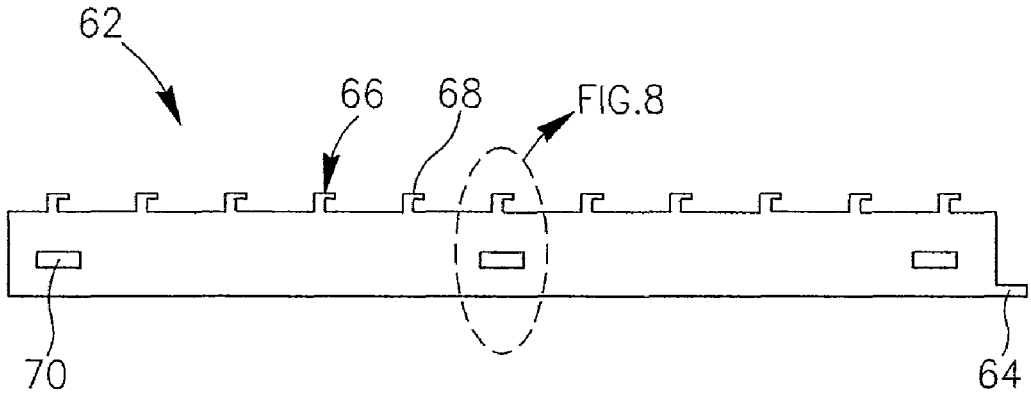
FIG. 7 is a front view of a locking bar of the drawer divider shown in FIG. 4.
Figure 8:
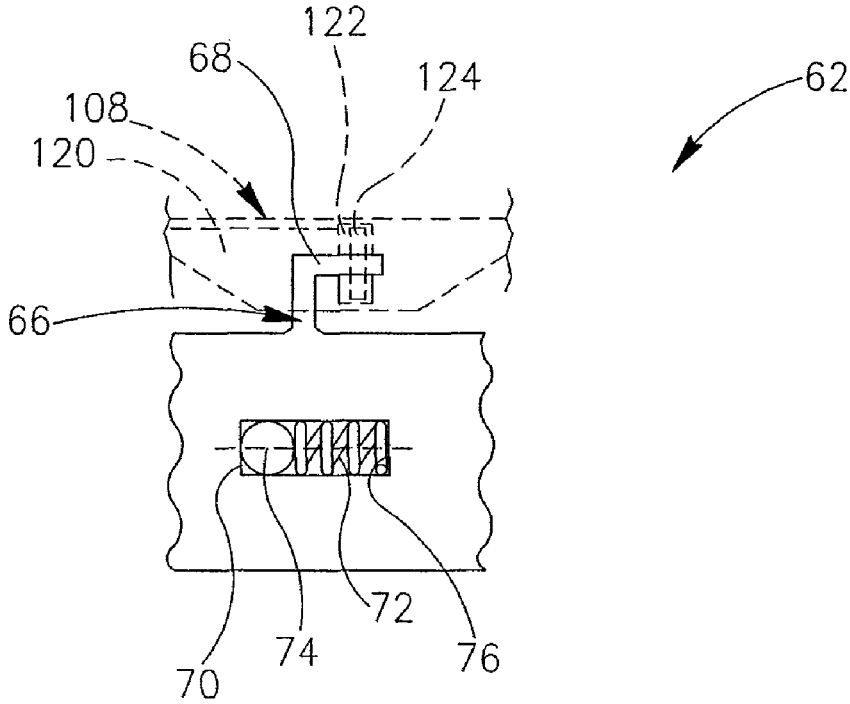
FIG. 8 is a detail view of the locking bar shown in FIG. 7.
Figure 11:
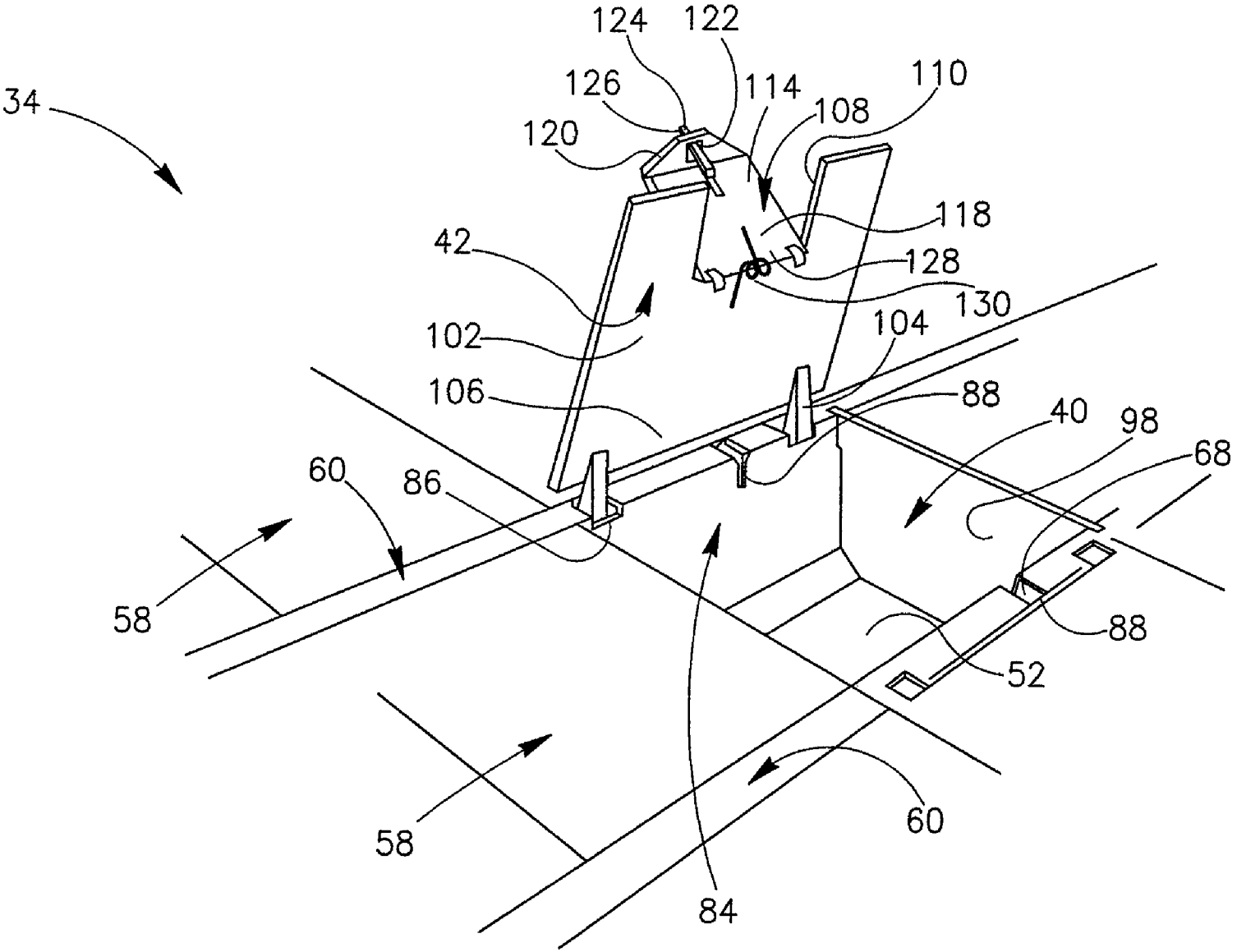
FIG. 11 is a detail perspective view of a bin of the drawer shown in FIG. 2.

As is best shown in FIGS. 4 and 11, the lid 42 has opposing lid top and lid bottom faces 100, 102. The lid 42 is hinged by a plurality of lid hinges 104 located adjacent a lid rear end 106 thereof to the drawer divider 60 adjacent the lid rear end 106. Each lid hinge 104 is located in the corresponding lid hinge aperture 86 of the drawer divider 60 adjacent thereto. The lid 42 can be shifted from a lid closed position to a lid open position. In the lid closed position, the lid 42 covers the bin 40 and prevents access thereto. In the lid open position, the lid 42 is lifted from the bin 40 to allow access thereto and to the items stored therein.

Each lid 42 is provided with at least one catch 108 located at a catch aperture 110 formed adjacent and opening to a lid front end 112. Generally, bins 40 extending over several cell columns 96 may be provided with lids 42 having more than one catch 108. The catch 108 has a catch lid portion 114 having opposing catch top and bottom faces 116, 118. A catch front portion 120 is integrally-formed with the catch lid portion 114 and extends from the catch bottom face 118 in a direction away from the catch top face 116 perpendicularly thereto. A strike 124 having a strike aperture 126 is fixed to the catch bottom face 118 and extends forwardly from the catch front portion 120 through a strike slot 122 formed therein. The catch 108 is hinged to the lid 42 at a catch rear end 128, and can be rotated about the catch rear end 128 from a catch open to a catch closed position. In the catch closed position, the catch top face 116 is typically flush with the lid top face 100, and the catch front portion 120 extends below the lid bottom face 102. In the catch open position, the catch front portion 120 is raised above the lid top face 100. The catch 108 is biased towards the catch open position by a catch biasing spring 130.

When the lid 42 is in the lid closed position, the bin 40 may be brought to a bin locked position, by securing the lid in the lid closed position, as will be discussed below, to prevent the lid 42 from being able to be transferred to the lid open position. The bin 40 is brought to the bin locked position by bringing the catch 108 to the catch closed position and placing the strike 124 of the catch 108 in the locking slot 88 of the drawer divider 60 adjacent thereto (see FIG. 6). By shifting the bolt portion 68 adjacent the strike 124 to a position in which it extends through the strike aperture 126, the catch 108 is locked in position and cannot be raised to the catch open position. Consequently, the lid 42 is also locked and cannot be brought to the lid open position. In order to gain access to the bin 40, the bin 40 is brought to a bin released position, by withdrawing the bolt portion 68 from the strike aperture 126. The catch 108 is now free to move to the catch open position under the influence of the biasing force of the catch biasing spring 130. As soon as the catch 108 is in the catch open position, the lid 42 may be transferred to the lid open position.

Figure 12:
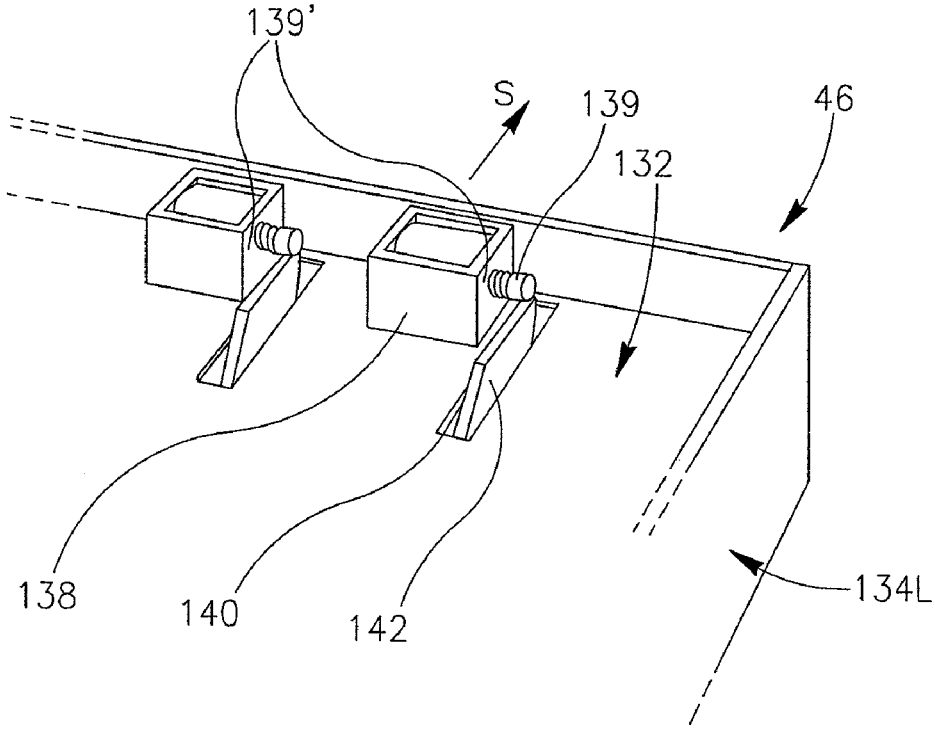
FIG. 12 is a detail top rear perspective view of a securing cross-beam of the drawer support shown in FIG. 2.
Figure 13:
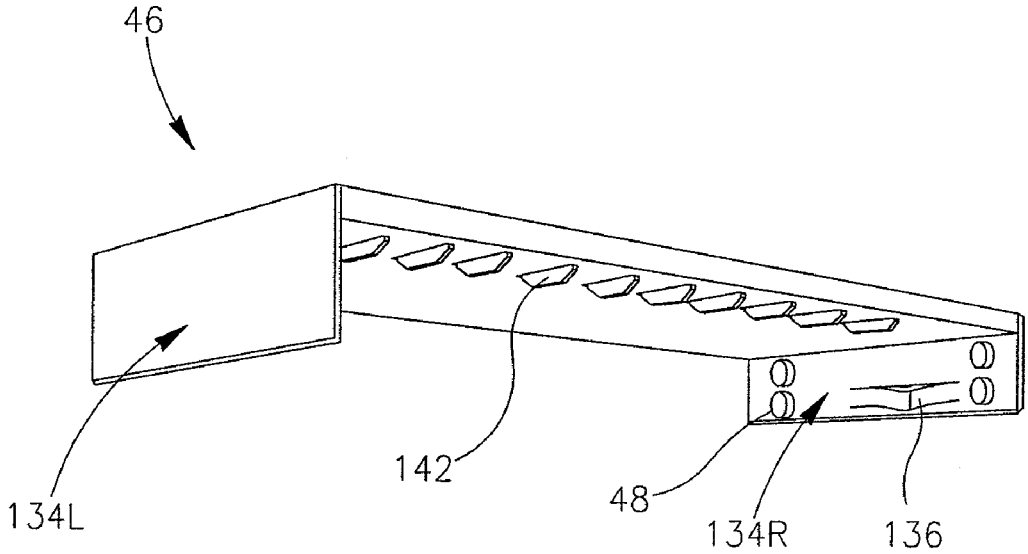
FIG. 13 is a bottom front perspective view of the securing cross-beam shown in FIG. 12.

Referring now to FIGS. 2, 12 and 13, the drawer support 46 has a securing beam 132 extending between right and left mounting flanges $\mathbf{134}_R$, $\mathbf{134}_L$. The right and left mounting flanges $\mathbf{134}_R$, $\mathbf{134}_L$ are affixed to the cabinet 32 by any suitable means. The right mounting flange $\mathbf{134}_R$ has a releasing member 136 extending inwardly therefrom. The securing beam 132 has M equally-spaced actuators 138 mounted thereon in a single row extending transversely to the sliding direction S. Preferably, the actuators 138 are of the electromechanical type, e.g., solenoids, and are individually connected to, and controlled by, the access-control system. Each actuator 138 has a stop member 139 in a form of a short rod extending transversely to the sliding direction S from an actuator side surface 139'. The stop member 139 is movable from an extended position, in which the actuator 138 is in an actuator securing position, to a retracted position (or a partially extended position), in which the actuator 138 is in an actuator releasing position 138. Each actuator 138 is associated with a lever through-slot 140 extending through the securing beam 132 and located adjacent the actuator side surface 139'. The lever through-slots 140 are elongated in form, each lever through-slot 140 extending parallel to the sliding direction S. Each lever through-slot 140 has a lid securing lever 142 located therein.

The lid securing lever 142 is rotatably secured to a plate 143 which is affixed to the securing beam 132. The lid securing lever 142 may be rotated about an axis of rotation A parallel to the actuator side surface 139' from a lever lowered position to a lever raised position. In the lever lowered position, the actuator 138 may be brought to the actuator securing position, to prevent the lid securing lever 142 from moving to the lever raised position. Bringing the actuator 138 to the actuator releasing position allows the lid securing lever 142 to move to the lever raised position. The lid securing lever 142 is biased towards the lever lowered position by its weight.

Figure 14:
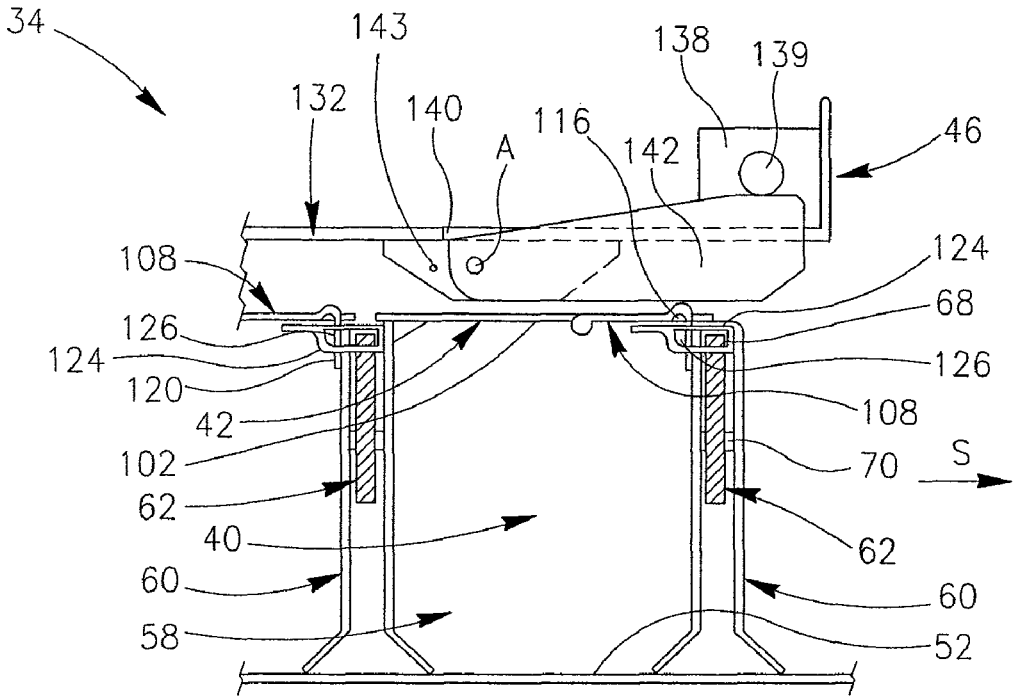
FIG. 14 is a schematic cross section of the drawer and drawer support showing a lid securing lever in a lever lowered position, taken along the plane XIV-XIV in FIG. 2.
Figure 15:
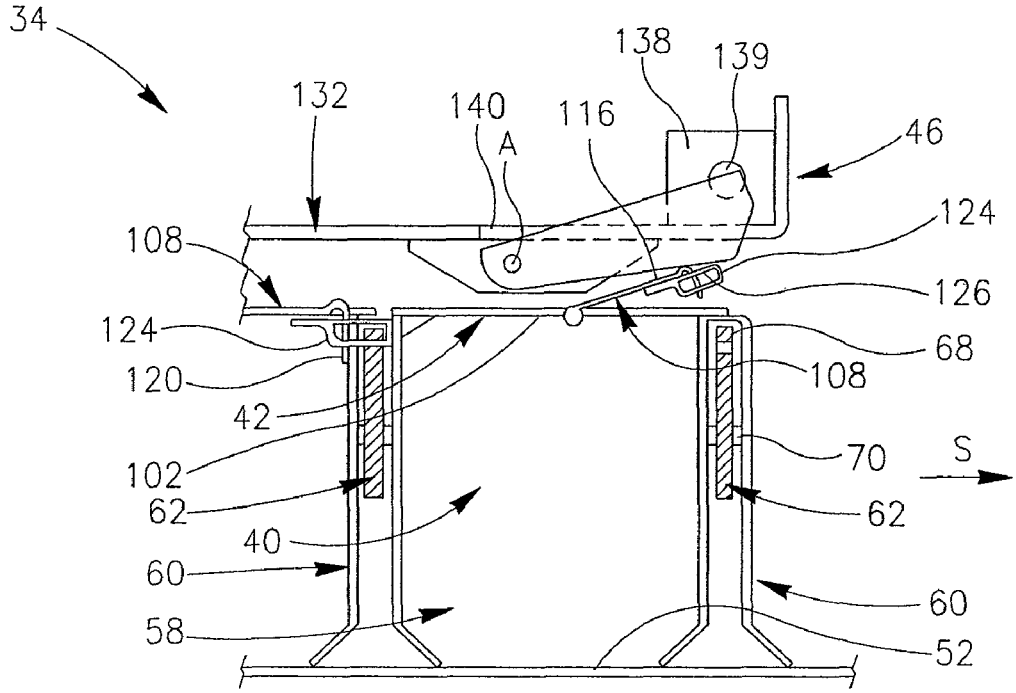
FIG. 15 is schematic cross section of the drawer and drawer support showing a lid securing lever in a lever raised position, taken along the plane XIV-XIV in FIG. 2.

Attention is now drawn to FIGS. 14 and 15. The method of operation of the dispensing system 30 will be discussed below with respect to a given bin 40 occupying a single cell 92. The given bin's 40 lid 42 has a single given catch 108. It will be appreciated that the method of operation applies equally well to bins extending over several cell columns and/or having lids provided with several catches. Initially, the drawer 34 is in the fully pushed-in position with all its bins 40 in the bin locked position. As the drawer 34 is pulled out from the cabinet 32, the given catch 108 slides forwardly under the corresponding lid securing lever 142. The locking bar 62 adjacent the given catch 108 passes along, and is engaged by, the releasing member 136. The releasing member 136 pushes against the releasing rod 64 and shifts the locking bar 62 to the bar releasing position. However, as long as the access-control system determines that the given bin 40 should be kept in the bin locked position, the actuator 138 associated with the lid securing lever 142 remains in the actuator securing position. In this position, the stop member 139 is in the extended position and is located directly above the lid securing lever 142 (see FIGS. 12, 14), thereby preventing upward movement of the lid securing lever 142. Thus, the lid securing lever 142 is forced to remain in the lever lowered position. When in the lever lowered position, the lid securing lever 142 abuts the catch top face 116, thereby preventing the given catch 108 from moving from the catch closed position. As the drawer 34 is drawn further forwardly, the releasing rod 64 clears the releasing member 136, the biased locking bar 62 returns to the bar locking position, and the given catch 108 is again secured in the catch closed position, thereby securing the lid 42 in the lid closed position and the bin 40 in the bin locked position.

If, however, the access-control system determines that the given bin 40 is to be opened it transfers the actuator 138 associated with the lid securing lever 142 to the actuator releasing position, as the given catch 108 slides forwardly under the associated lid securing lever 142. With the actuator 138 in the actuator releasing position, the stop member 139 is in the retracted position, so that it is no longer located directly above the lid securing lever 142. Consequently, upward movement of the lid securing lever is no longer prevented. When the locking bar 62 is shifted to the bar releasing position, as it engages the releasing member 136, the catch 108 is released and urged by the catch biasing spring 130 to the catch open position. As the given catch 108 is urged to the catch open position, it urges the lid securing lever 142 to the lever raised position, against the biasing weight thereof (see FIG. 15), as the upward movement of the lid securing lever 142 is no longer inhibited when the actuator 138 is in the actuator releasing position, with the stop member 139 being in the retracted position.

As the drawer is pulled further forwardly to the fully-opened position the releasing rod 64 clears the releasing member 136 and the biased locking bar 62 returns to the bar locking position. However, since the given catch 108 is in the catch open position, and is raised (see FIG. 15), its strike 124 is above the drawer divider 60 adjacent thereto and the bolt portion 68 of the locking bar 62 associated therewith. Therefore, as the biased locking bar 62 returns to the bar locking position, the bolt portion 68 does not pass through the strike aperture 126, but instead passes below the strike 124. When the now-released catch 108 clears the associated lid securing lever 142, the lid securing lever 142 returns to the lever lowered position by own biasing weight, allowing the control system to return the actuator 138 to the actuator securing position by extending the stop member 139 to the extended position. The catch 108 remains in the catch open position, with its strike above the associated bolt portion 68, indicating that the given bin 40 is released and the lid 42 thereof may be opened to gain access to the items stored in the given bin 40.

When the given drawer 34 is urged rearwardly into the cabinet 32 to the drawer pushed-in position, the given bin 40 passes under the securing beam 132. The lid securing lever 142 associated with the given bin 40, and now locked by the actuator 138 in the lever lowered position, urges the given lid 42 and catch 108 to the lid and catch closed positions, respectively. As the releasing rod 64 engages the releasing member 136, the locking bar 62 is urged to the bar releasing position against the biasing force of the locking spring 72, causing the bolt portion 68 to withdraw from the locking slot 88. Consequently, the strike 124 of the given catch 108 can enter its locking slot 88. Further rearwards movement of the given drawer 34 causes the releasing rod 64 to clear the releasing member 136. The biased locking bar 62 then returns to the bar locking position while the lid securing lever 142 keeps the given catch 108 in the catch closed position. The bolt portion 68 can then pass through the strike aperture 126, thereby securing the bin 40 in the bin locked position. The present invention, therefore, facilitates independent and individual locking and releasing of a plurality of bins 40 of a given drawer 34 configured in an N×M cell array by employing only M individually-controlled actuators. Thus, and as can be seen from FIGS. 2, 10 and 12, the same actuator controls all catches 108 associated with a given column, and thereby controls a plurality of lockable lids 42 associated with different cell rows and belonging to different bins 40.

It can be seen that a device as disclosed herein potentially provides a number of advantages First, it may facilitate secured storage of items while providing controlled access thereto and dispensing thereof.

Second, it may provide modular, easily configurable storage for a plurality of diverse items, while significantly reducing the required number of actuators needed to operate the dispensing system, by reducing electromechanical actuators count to M, for a given drawer having a cell array of M columns by N rows, as compared with M×N or, at least, M+N actuators required by prior-art devices, thereby contributing to reduced costs and increased reliability of the dispensing system.

Also, positioning the electromechanical actuators in fixed positions in the cabinet, eliminates electrical connections between stationary and movable assemblies of the dispensing system, which may further contribute to increased reliability of the dispensing system and therefor in better availability of the items stored therein.

Although the present invention has been described to a certain degree of particularity, it should be understood that alterations and modifications to the present invention may possibly be made without departing from the scope of the invention as hereinafter claimed.

What is claimed is:

1. A dispensing system (30) comprising a cabinet (32) having at least one drawer (34), each drawer having a plurality of bins (40), each bin occupying at least one cell (92) of a drawer cell array (90) having an integer number M cell columns (96) and an integer number N cell rows (94), wherein M and N are positive integers and each is at least two;

each bin being provided with a lockable lid (42) and being selectively transferable between a bin released position and a bin locked position by at least one electrically controlled actuator (138) mounted on the cabinet (32), said at least one actuator (138) being transferable between an actuator securing position and an actuator releasing position to control said lockable lid (42); wherein:

the number of actuators (138) for said at least one drawer is not greater than M per drawer; and a plurality of lockable lids (42) associated with different cell rows and belonging to different bins (40) are controlled by the same actuator (138).

2. The dispensing system (30) in accordance with claim 1, wherein the at least one drawer (34) comprises at most N compartments (58), each compartment extending over at least one cell row (94) and being defined between adjacent drawer dividers (60) extending transversely to a sliding direction (S) of the drawer (34).

3. The dispensing system (30) in accordance with claim 2, wherein each drawer divider (60) comprises a plurality of bin partition slots (82) arrayed equidistantly therealong defining M equally-sized divider segments (84) thereon, each divider segment comprising spaced-apart lid hinge apertures (86) and a locking slot (88) located therebetween.

4. The dispensing system (30) in accordance with claim 3, wherein each drawer divider (60) accommodates a locking bar (62) transferable between bar locking and bar releasing positions and comprising M locking latches (66) arrayed equidistantly therealong;

each locking latch (66) comprises a bolt portion (68) extending parallel to the locking bar (62); so that:

when the locking bar (62) is in the bar locking position, each bolt portion (68) extends across the locking slot (88) associated therewith; and when the locking bar (62) is in the bar releasing position, each bolt portion (68) is withdrawn from the associated locking slot (88).

5. The dispensing system (30) in accordance with claim 1, wherein each lid (42) is transferable from a lid closed position, in which the lid (42) covers the bin (40), to a lid open position, in which the lid (42) is lifted from the bin (40) to allow access thereto.

6. The dispensing system (30) in accordance with claim 5, wherein each lid (42) is provided with at least one catch (108) comprising a strike (124) having a strike aperture (126) formed therein, the strike extending forwardly from a catch front portion (120).

7. The dispensing system (30) in accordance with claim 6, wherein:

the catch (108) can be transferred relative to the lid (42) from a catch closed position to a catch open position;

in the catch closed position, a catch top face (116) is generally parallel to a lid top face (100), and the catch front portion (120) extends below a lid bottom face (102); and in the catch open position, the catch front portion (120) is raised above the lid top face (100).

8. The dispensing system (30) in accordance with claim 7, wherein the catch (108) is biased towards the catch open position.

9. The dispensing system (30) in accordance with claim 8, wherein:

each drawer divider (60) comprises a plurality of bin partition slots (82) arrayed equidistantly therealong defining M equally-sized divider segments (84) thereon, each divider segment comprising spaced-apart lid hinge apertures (86) and a locking slot (88) located therebetween; and in the bin locked position, the lid (42) is in a lid closed position, the catch (108) is in the catch closed position, the strike (124) is located in the locking slot (88) of the divider segment (84) adjacent thereto.

10. The dispensing system (30) in accordance with claim 9, wherein:

each drawer divider (60) accommodates a locking bar (62) transferable between bar locking and bar releasing positions and comprising M locking latches (66) arrayed equidistantly therealong;

each locking latch (66) comprises a bolt portion (68) extending parallel to the locking bar (62); so that:

when the locking bar (62) is in the bar locking position, each bolt portion (68) extends across the locking slot (88) associated therewith; and when the locking bar (62) is in the bar releasing position, each bolt portion (68) is withdrawn from the associated locking slot (88); and the bolt portion (68) associated with the locking slot (88) extends through the strike aperture (126).

11. The dispensing system (30) in accordance with claim 10, wherein when the bin (40) is in the bin released position, the bolt portion (68) is withdrawn from the strike aperture (126) and the catch (108) is transferred to the catch open position by the biasing force of a catch biasing spring (130).

12. The dispensing system (30) in accordance with claim 1, wherein the at least one drawer (34) is associated with a drawer support (46) fixed to the cabinet (32) and accommodated therein, the drawer support (46) comprises a securing beam (132) having a single row of M equally-spaced actuators (138) extending transversely to the sliding direction (S) mounted thereon.

13. The dispensing system (30) in accordance with claim 12, wherein each actuator (138) is associated with a lid securing lever (142) transferable between lever lowered and lever raised positions.

14. The dispensing system (30) in accordance with claim 13, wherein when the lid securing lever (142) is in the lever lowered position, and the actuator (190) is in the actuator securing position, the lid securing lever (142) is prevented from transferring to the lever raised position.

15. The dispensing system (30) in accordance with claim 14, wherein when the lid securing lever is in the lever lowered position, and the actuator is in the actuator securing position, the lid securing lever urges lids (42) and catches (108) sliding therebelow to the lid closed and catch closed positions.

* * * * *